US006312562B1

(12) United States Patent
Bartelmuss et al.

(10) Patent No.: US 6,312,562 B1
(45) Date of Patent: Nov. 6, 2001

(54) TRAVELING SCREEN SYSTEM

(76) Inventors: Klaus Bartelmuss; Heinz Bartelmuss, both of Nr. 63, A-8833 Teufenbach (AT)

( * ) Notice: Subject to any disclaimer, the term of this patent is extended or adjusted under 35 U.S.C. 154(b) by 0 days.

(21) Appl. No.: 09/429,826

(22) Filed: Oct. 29, 1999

(30) Foreign Application Priority Data

Dec. 22, 1998 (AT) ..... 2136/98

(51) Int. Cl.[7] ..... D21F 7/04

(52) U.S. Cl. ..... 162/257; 162/273; 162/252; 162/199; 474/104; 474/101; 474/102; 474/103; 474/109; 474/127; 226/21; 226/23

(58) Field of Search ..... 474/101–4, 109, 474/112, 127; 162/257, 273, 252, 199; 226/21, 23

(56) References Cited

U.S. PATENT DOCUMENTS 1,755,202 * 4/1930 Brecht et al. ..... 162/257
4,479,787 * 10/1984 Bonnard ..... 474/82
4,966,653 * 10/1990 Rantala et al. ..... 162/257
5,728,018 * 3/1998 Terada et al. ..... 474/80

* cited by examiner

*Primary Examiner*—Stanley S. Silverman
*Assistant Examiner*—Mark Halpern
(74) *Attorney, Agent, or Firm*—Herbert L. Lerner; Laurence A. Greenberg; Werner H. Stemer

(57) ABSTRACT

A traveling screen system has a traveling screen guided about a multiplicity of support and guide rollers. A scanning device scans a transverse position of the traveling screen and an adjusting device adjusts the angular orientation of at least one of the support and guide rollers. The adjusting device is supported on one side on a displaceable bearing block which is supported on a carriage. Between the control device for the bearing block of the displaceable roller and the scanning device, a coupling is provided by which a return of the control motion of the roller to the scanning device is effected. The coupling is formed by a Bowden cable, by a hydraulic circuit with control cylinders, or by an electric circuit with control devices.

10 Claims, 10 Drawing Sheets

TRAVELING SCREEN SYSTEM

BACKGROUND OF THE INVENTION

Field of the Invention

The present invention relates to a traveling screen system, having a multiplicity of support and guide rollers, by way of which traveling screen is guided. A device is provided for scanning the transverse position of the traveling screen and a device for adjusting the angular position of at least one of the support and guide rollers. The latter device is supported on one side on a displaceable bearing block. Between the control device for the bearing block of the displaceable roller, which bearing block is disposed on a carriage, and the scanning device, a coupling is provided by which a return of the control motion of the roller toward the scanning device is effected.

Prior art traveling screen systems, which are used in the paper industry, for instance, have many rollers over which a traveling screen is guided. In a traveling screen system that is one of the components of a system for creating a web of paper, squeegee strips and suction devices are also located between the rollers. At the beginning of the traveling screen, a liquid paper pulp is sprayed onto it. Over the course of the traveling screen and its direction of motion, the water contained in the paper pulp passes through the traveling screen, is removed from the underside of the traveling screen by the squeegee strips, and is aspirated away by the suction devices. At the end of the system, a paper web is separated from the traveling screen; the web is then rolled, surface-treated and cut.

For a proper sequence of operation, it is necessary to assure that the traveling screen maintain its direction of motion in the longitudinal direction of the traveling screen system. If any deviation in the direction of motion of the traveling screen occurs, provisions for controlling the traveling screen must be taken, which comprise slightly pivoting the angular position of at least one of the rollers whose pivot axes form a right angle with the longitudinal direction of the traveling screen system. By means of this kind of change in the angular position of at least one of the rollers, it is true that the traveling screen is adjusted slightly transversely to the longitudinal direction of the traveling screen system, but the direction of motion of the traveling screen system is corrected so that it again runs in the longitudinal direction of the traveling screen system.

To detect any deviation in the direction of motion of the traveling screen, it has become known in the art to provide a scanner laterally of the traveling screen. If any change in the direction of motion of the traveling screen occurs, causing one of the side edges of the traveling screen to migrate laterally and exceed a predetermined limit value, then the scanner responds and trips a control event. The control event comprises adjusting the angular position of at least one roller assigned to the scanner. To that end, one of the two bearing blocks of this roller is supported on a carriage, with which a pneumatic or hydraulic control piston is associated. A valve which is controlled by the scanner is located in the control circuit of the control piston. As soon as the scanner, as a consequence of the lateral migration of the traveling screen, responds, the valve in the control circuit is controlled by the scanner in such a way that the bearing block of the roller is displaced. This changes the angular orientation of the roller and the desired correction in the direction of motion of the traveling screen is brought about.

In such control events, however, there is the further requirement of avoiding overcorrections. The reason why overcorrections can be caused is that, as noted above, while a deviation in the direction of motion of the traveling screen from the longitudinal direction of the traveling screen system is to be prevented, nevertheless at the same time a lateral offset of the traveling screen is intended to be allowable, since by means of it irregularities in the traveling screen can be taken into account. If accordingly the control of the angular position of at least one roller is derived solely from the lateral deviation of the traveling screen, then this would lead to an extensive pivoting of the roller, that is to the afore-mentioned overcorrection. To avoid such overcorrections, it has also become known in the art to provide a so-called return guide. This is a device by which, as a result of the change in the angular position of the roller, an adjustment of the control valve counter to the adjustment effected by the scanner is brought about. Thus by means of the return guide, the change in angular position of the at least one adjustable roller effected by the scanner is reduced.

Prior art return guides of this kind have a control rod, which are hinged on the one hand on the displaceable bearing block for the roller and on the other on a carrier for the control valve. As soon as the bearing block is adjusted, an adjustment of the carrier for the control valve also occurs, as a result of which the desired effect of reduction of the controlling variable is attained.

Such prior art devices for return guidance, which include a control rod, are however not capable of meeting the demands or spatial conditions, because they dictate that the scanner and the control device for the bearing block be located directly side by side. This in turn creates the requirement that the traveling screen system be disposed such that the space required for the side-by-side scanner and control device is available. It is often difficult to meet this requirement however, because of spatial conditions.

SUMMARY OF THE INVENTION

It is accordingly an object of the invention to provide a traveling screen system, which overcomes the above-mentioned disadvantages of the heretofore-known devices and methods of this general type and in which the scanning device, on the one hand, and the control device for the bearing block of the at least one displaceable roller, on the other hand, can be disposed at arbitrary points to suit the spatial conditions, without this causing any functional impairment of the return guide.

With the foregoing and other objects in view there is provided, in accordance with the invention, a traveling screen system, comprising:

a plurality of support and guide rollers;

a traveling screen guided about the support and guide rollers;

a scanning device disposed to scan a transverse position of the traveling screen;

a carriage supporting a displaceable bearing block of one of the support and guide rollers;

an adjusting device for adjusting an angular orientation of the one support and guide roller by adjusting a position of the bearing block; and feedback coupling means between the adjusting device and the scanning device for feeding back a control motion of the one support and guide roller to the scanning device. The coupling is either Bowden cable, a hydraulic loop with a plurality of control cylinders, or an electric circuit with a plurality of control devices.

In accordance with an added feature of the invention, the carriage is supported on a carrier, and a two-armed control lever supported on the carrier, the two-armed control lever including a first arm coupled to the carriage and a second arm coupled to the feedback coupling means.

In accordance with an additional feature of the invention, the first arm of the control lever is formed with a slit, and the bearing block has a final control element engaging into the slit.

In accordance with another feature of the invention, the final control element of the bearing block is shiftable in position relative to the control lever, for varying a controlling variable effected by a displacement of the bearing block.

In accordance with a further feature of the invention, a tension cable of the Bowden cable is hinged to the second arm of the control lever.

In accordance with again a further feature of the invention, the feedback coupling means comprise an hydraulic circuit including a first hydraulic cylinder with a piston rod hinged to the second arm of the control lever, a second hydraulic cylinder with a piston rod hinged to the scanning device, and a plurality of hydraulic lines connecting the first and second hydraulic cylinders.

In accordance with a concomitant feature of the invention, the feedback coupling means comprise an electric circuit and a control element for the electric circuit hinged to the second arm of the control lever, and an electric motor connected to the electric circuit for adjusting the scanning device.

Other features which are considered as characteristic for the invention are set forth in the appended claims.

Although the invention is illustrated and described herein as embodied in a traveling screen system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
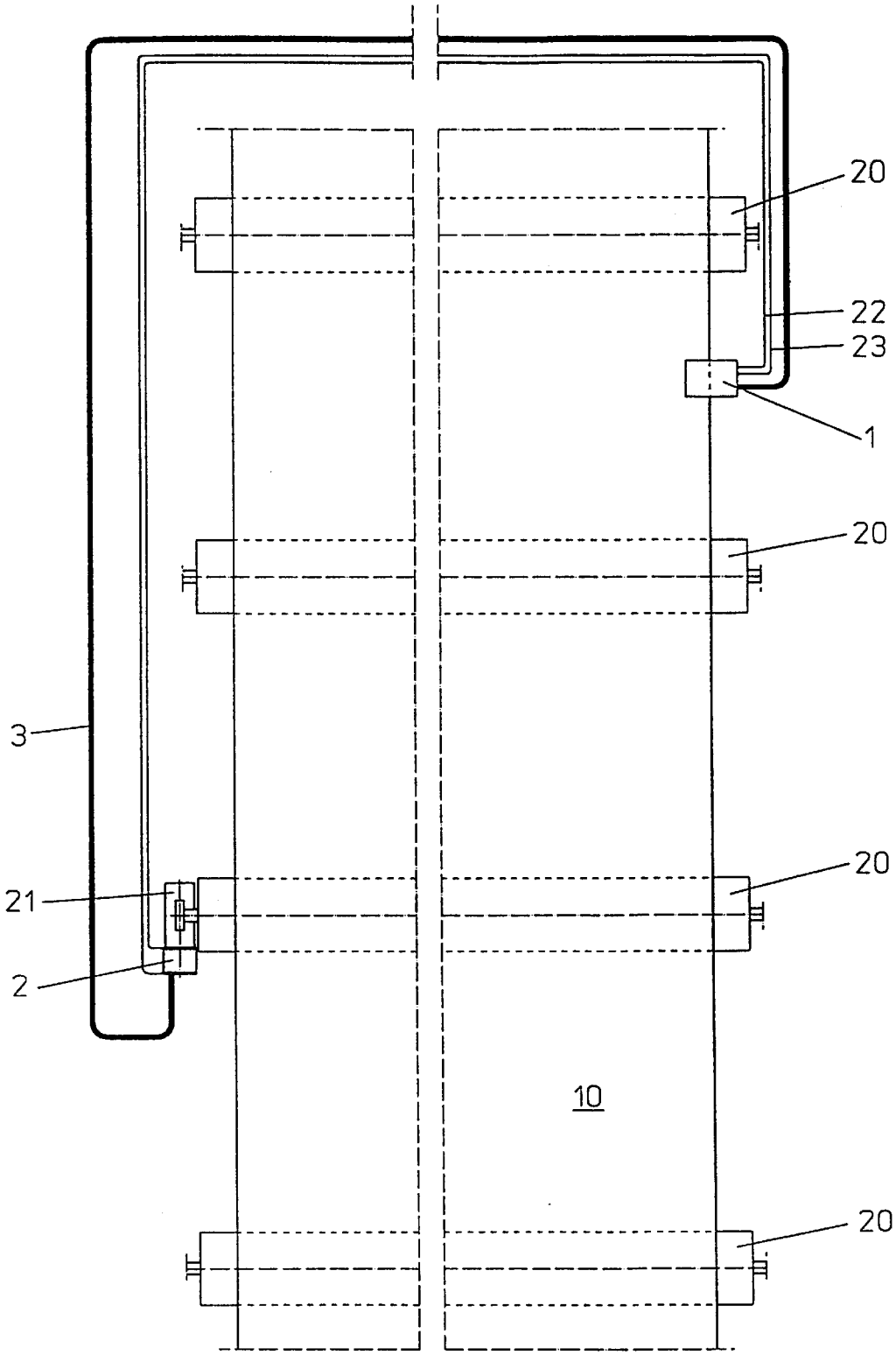
FIG. 1 is a diagrammatic plan view of a traveling screen system with a scanning device and a control device for one of the rollers.

Referring now to the figures of the drawing in detail and first, particularly, to FIG. 1 thereof, there is seen a traveling screen system with a multiplicity of rollers 20, over which a traveling screen 10 is guided which is moved by the rollers 20 longitudinally of the system. A plurality of devices are associated with the traveling screen 10 in the processing installation. Due to the fact that those devices are well known to those of skill in the art and they are not relevant to the present invention, they are not illustrated herein. Located on one of the lateral side edges of the traveling screen 10 is a scanner or scanning device 1, by which any deviation in the position of the traveling screen 10 from the center position is ascertained. The scanning device 1 communicates via pneumatic control lines 22 and 23 with a control cylinder 2 for a displaceable bearing block 21 of one of the rollers 20. As soon as the scanning device 1 responds, the bearing block 21 is displaced longitudinally of the traveling screen system, as a result of which the roller 20 supported in it is pivoted relative to the normal to the longitudinal axis of the traveling screen system. This effects a correction in the direction of motion of the traveling screen 10, such that the traveling screen again runs in the longitudinal direction of the system.

In order, however, to avoid overcorrections, a return guide 3 is provided between the scanning device 1 and the control cylinder 2. The structure and mode of operation of the return guide device are described below.

Figure 2:
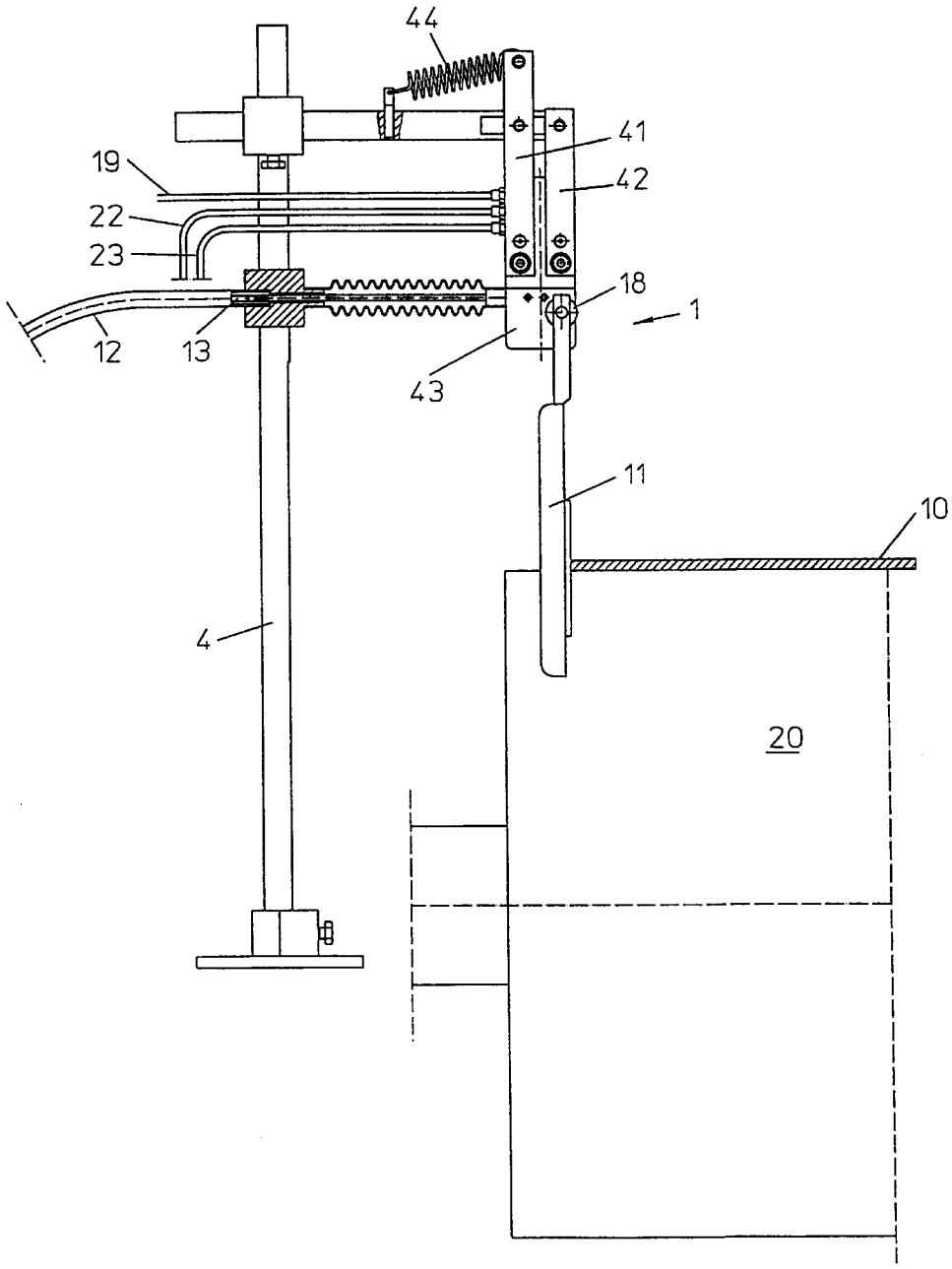
FIG. 2 is a partly sectional view of a scanning device, embodied with a return guide device according to the invention, viewed in the direction of motion of the traveling screen.
Figure 3:
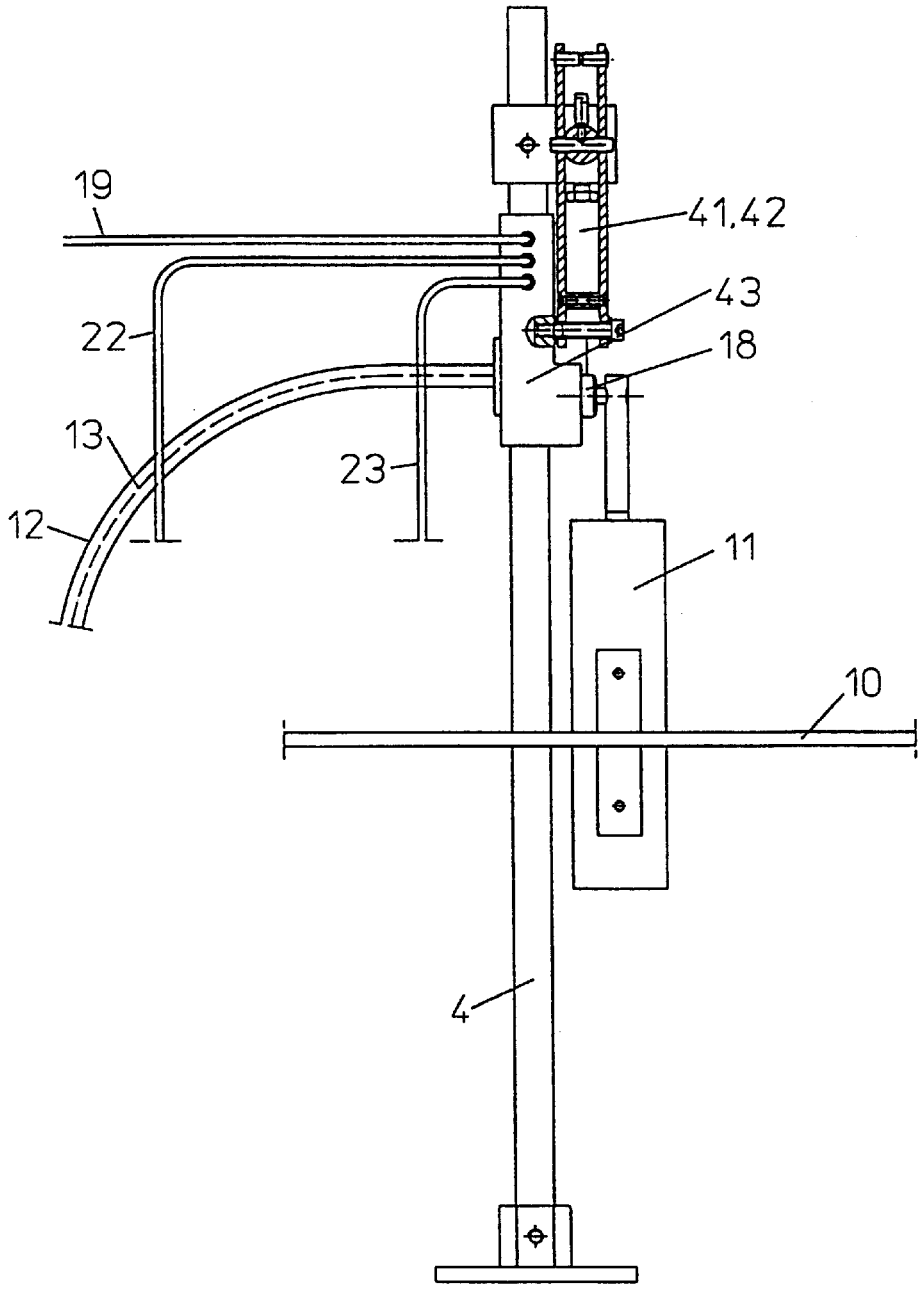
FIG. 3 is a partly sectional view of the scanning device of FIG. 2, viewed transversely to the direction of motion of the traveling screen.

With reference to FIGS. 2 and 3, the scanning device is disposed on a stationary carrier 4, on which two support arms 41 and 42, parallel to one another, are pivotably supported. Supported on the support arms 41 and 42 is a support plate 43, on which a control valve 18 is disposed and on which a scanner lever 11 is pivotably supported. The two support arms 41 and 42 are under the influence of a control spring 44. The control lines 22 and 23 originate at the control valve 18 and lead to the control cylinder 2 of the displaceable bearing block 21. The supply to the control valve 18 is made via a pressure line 19.

One end of a Bowden cable 12, whose tension cable 13 is secured to the support plate 43, is also secured to the carrier 4.

Figure 4:
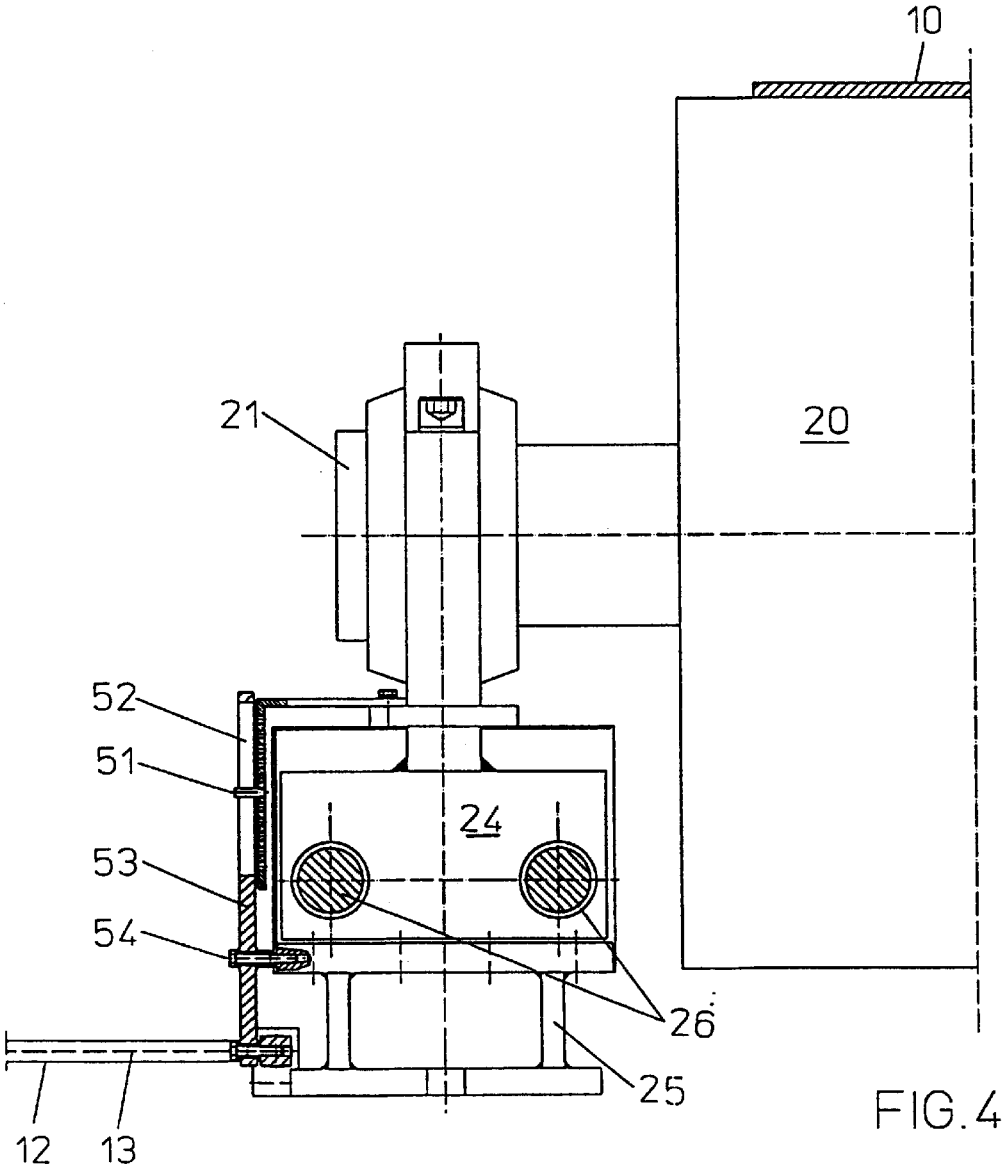
FIG. 4 is a partly sectional view of a bearing block, embodied with a return guide device of the invention, for a pivotable roller, viewed in the direction of motion of the traveling screen.
Figure 5:
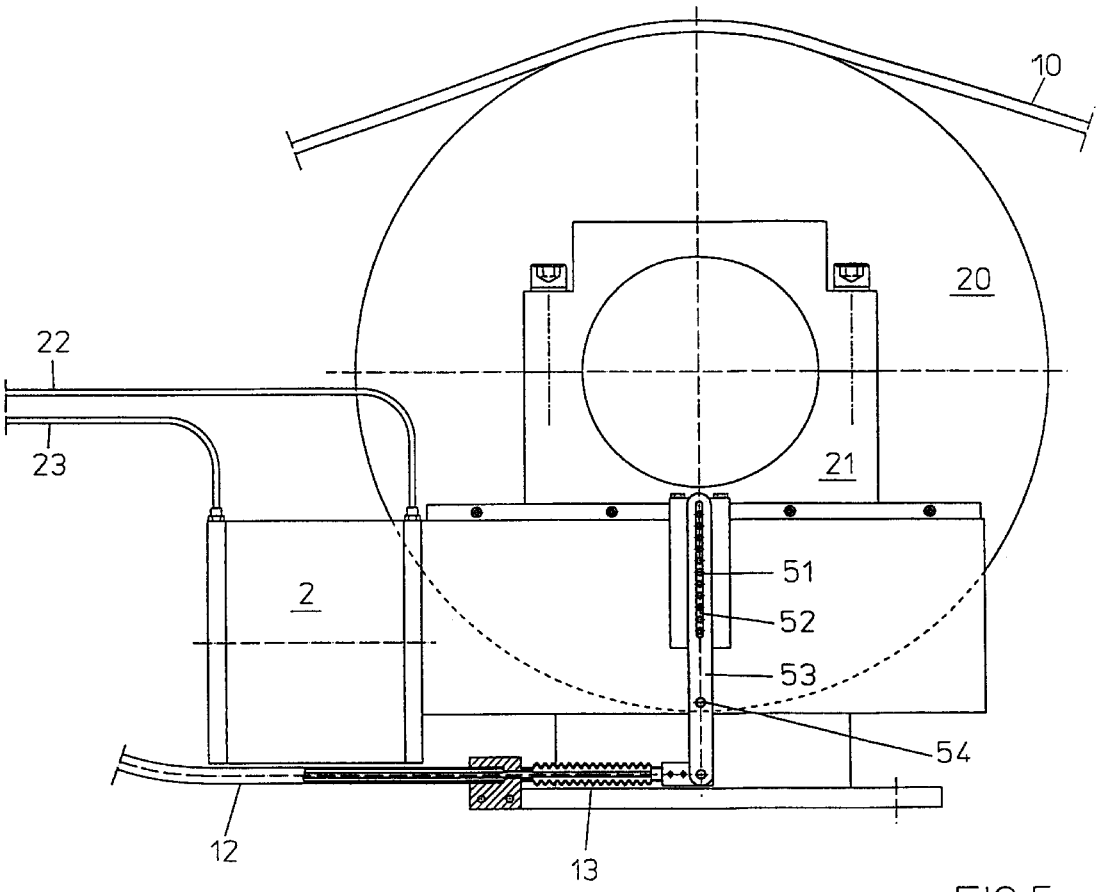
FIG. 5 is a diagrammatic view of the bearing block of FIG. 4, viewed transversely to the direction of motion of the traveling screen, in the center position.
Figure 6:
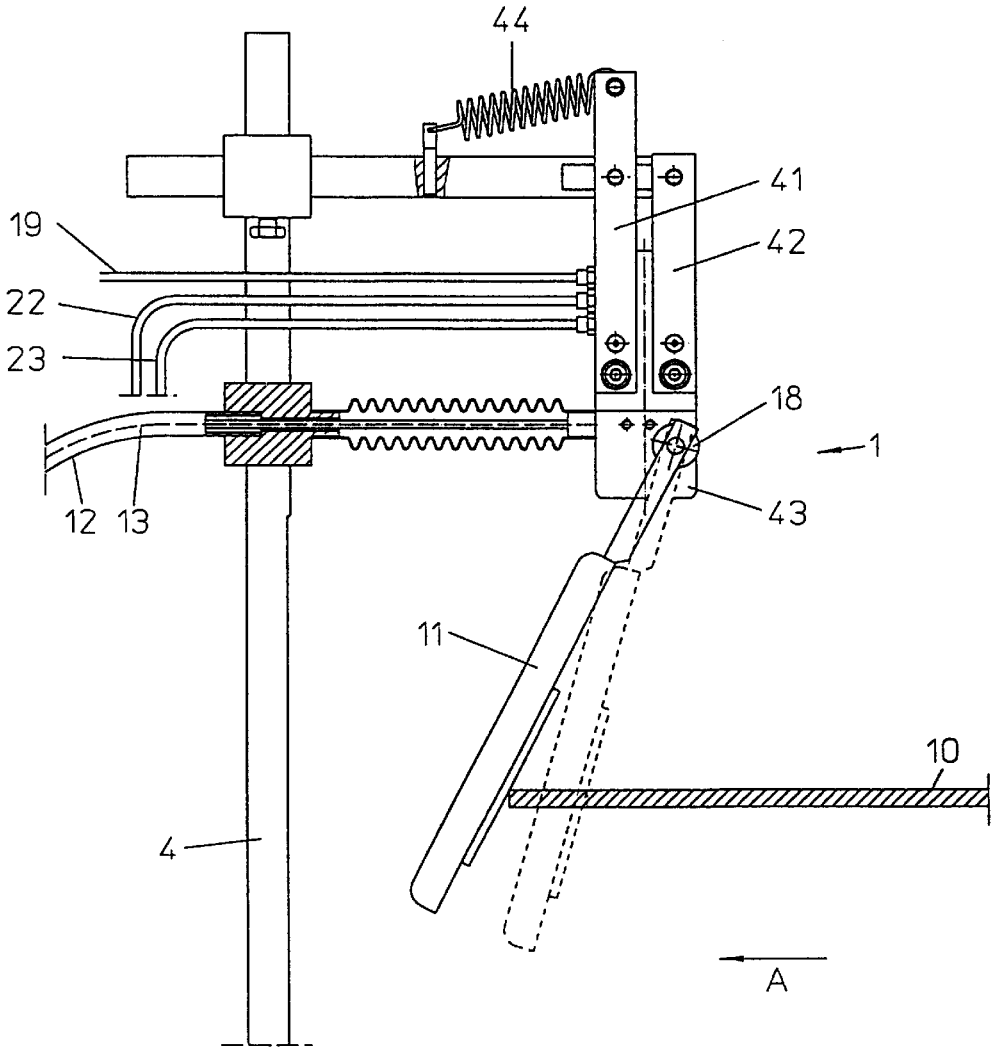
FIG. 6 is a partly sectional view of the scanning device in its function in the event of migration of the traveling screen, viewed in the direction of motion of the traveling screen.
Figure 7:
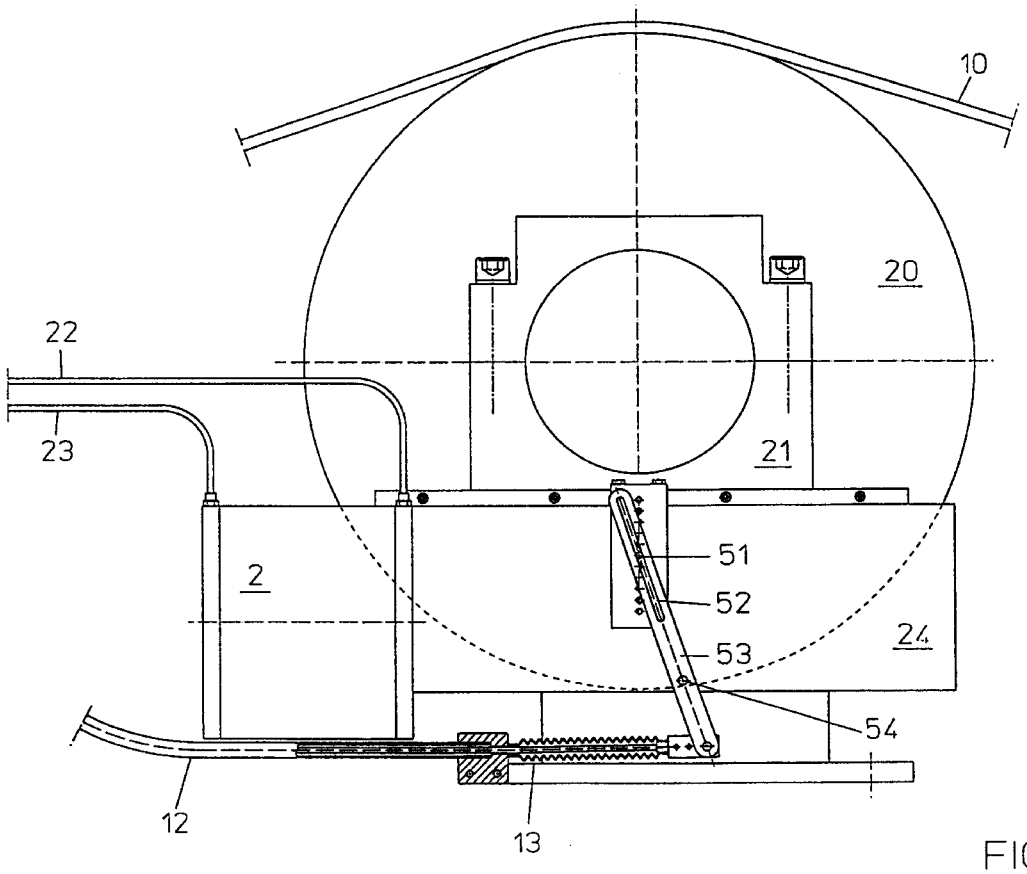
FIG. 7 is a diagrammatic view of the bearing block of the pivotable roller, in a position deviating from the center position, with the corresponding position of the return guide device.
Figure 8:
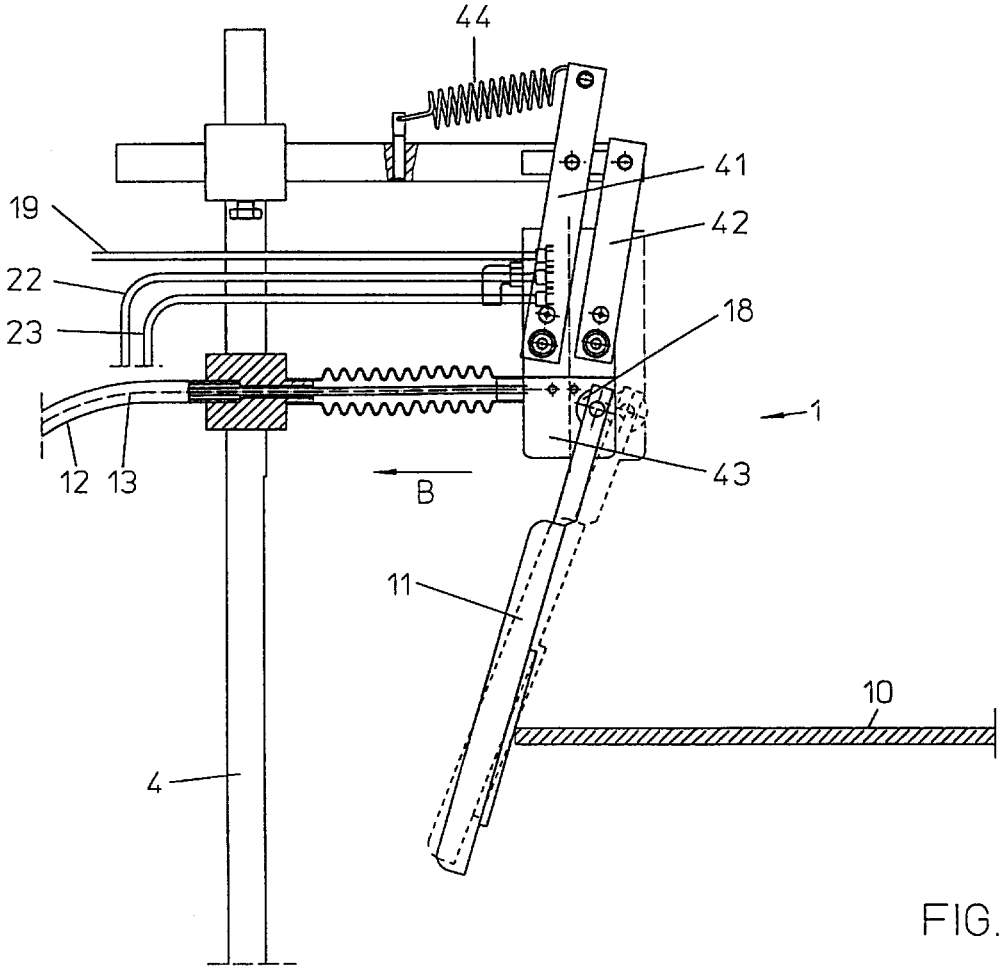
FIG. 8 is a partly sectional view of the scanning device in its position changed because of the return guidance, viewed in the longitudinal direction of the traveling screen.

As further shown in FIGS. 4 and 5, the movable bearing block 21 is supported by a carriage 24, which is displaceable in a stationary carrier 25 along rods 26 by means of the control cylinder 2. Protruding from the carriage 24 is a peg 51 which protrudes into a longitudinal slot 52 of a control lever 53. The control lever 53 is pivotably supported on the carrier 23 for the carriage 24 by means of a peg 54. The tension cable 12 of the Bowden cable 13 is hinged to the free end of the control lever 53. In FIG. 5, the center position of the control lever 53 is shown. In FIG. 6, the center position of the scanner lever 11 is shown in dash-dotted lines. As soon as the traveling screen 10 migrates laterally in the direction of the arrow A, which causes the scanner lever 11 to pivot, an imposition on the control cylinder 2 takes place via the control valve 18, so that, as shown in FIG. 7, the bearing block 21 is displaced leftward, and as a result the control lever 53 is pivoted counter-clockwise. As a result, a tension is exerted on the tension cable 13 of the Bowden cable 12, and as shown in FIG. 8, the carrier 43 and the scanner lever 11 are thereby adjusted in the direction of the arrow B out of the positions shown in dot-dashed lines to the positions shown in solid lines. As a result, because of a lateral motion of the traveling screen 10, the scanner lever 11 is not pivoted as much as would be the case in response to a lateral migration of the traveling screen 10 if no return guide were provided. Overcorrection is thereby avoided.

To enable controlling the extent of the adjustment of the support plate 43 caused by the displacement of the bearing block 21, the peg 51 can also be inserted in terms of its height into different bores that are provided in the carriage 25. The greater the spacing of the peg 51 from the pivot peg 54 of the control lever 53, the slighter is the adjustment of the support plate 43 caused by a displacement of the carriage 22.

Since the return guidance is effected by the Bowden cable 12, there are no limitations whatever in terms of the mutual disposition of the control device 2 for the displaceable bearing block 21 and the scanning device 1. Instead, these devices can be disposed at arbitrary distances from one another, without their operability being impaired thereby.

Figure 9:
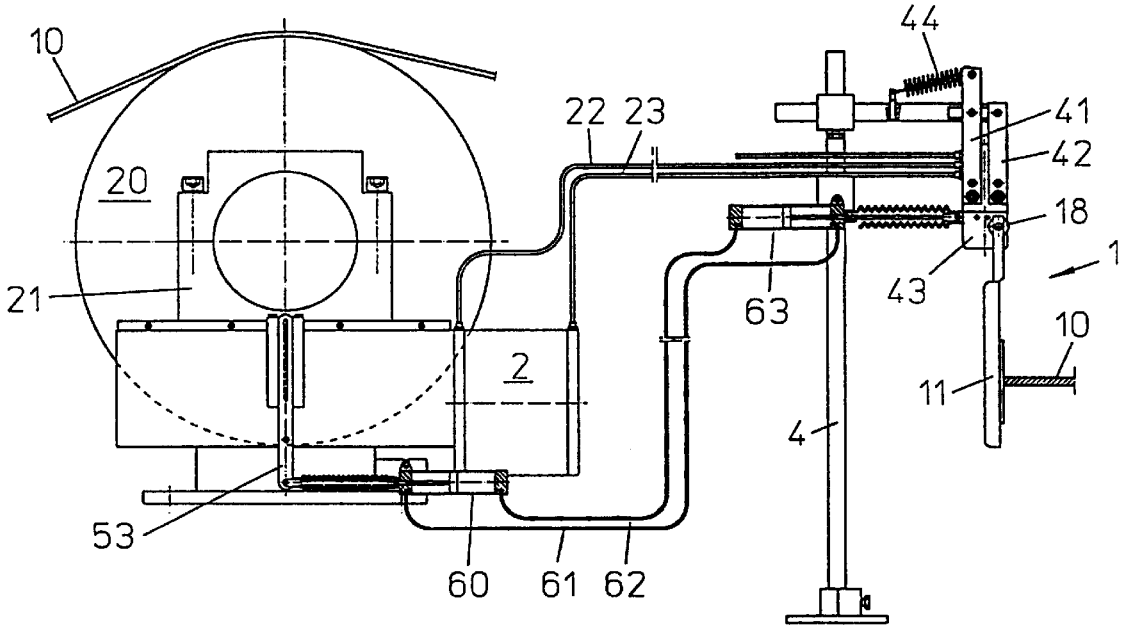
FIG. 9 is a diagrammatic view of a second embodiment of the return guide device.

In the second embodiment, shown in FIG. 9, the return guidance is effected in that the control lever 53 is coupled with the piston of a further control cylinder 60, to which hydraulic lines 61 and 62 are connected that lead to a further control cylinder 63, disposed on the carrier 4 for the scanning device 1, whose piston is hinged onto the support plate 43 for the scanner lever 11.

Figure 10:
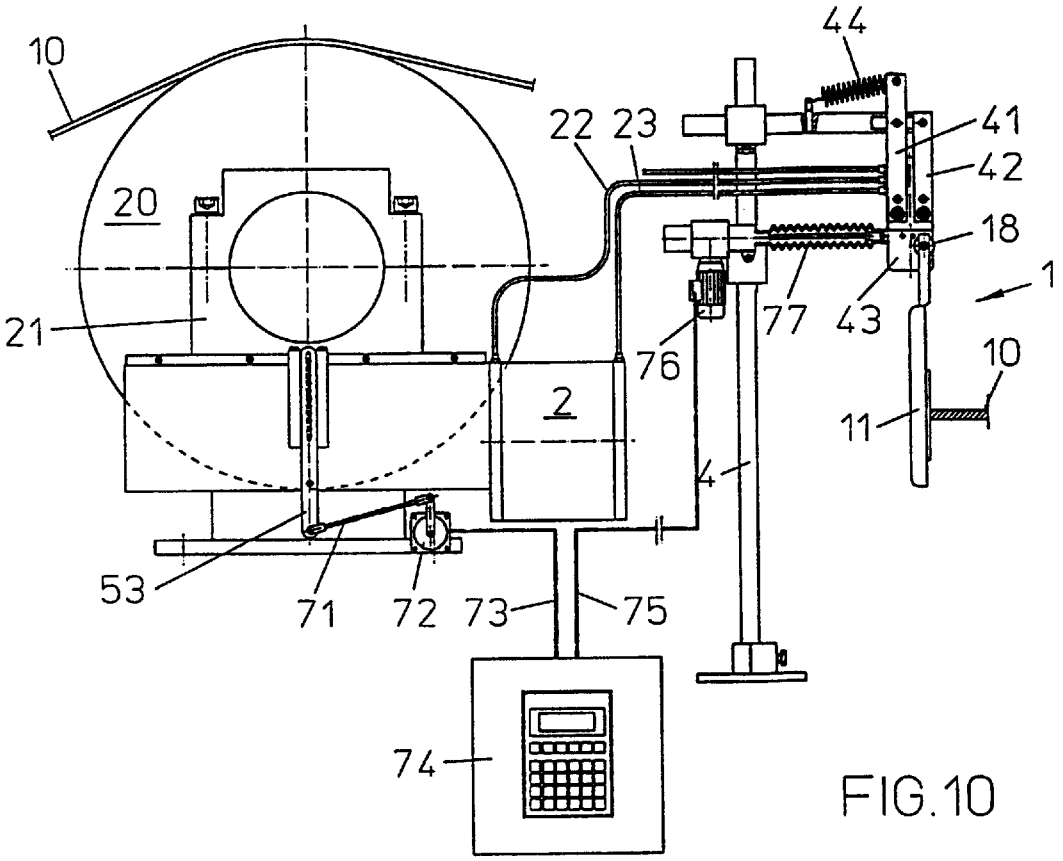
FIG. 10 is a diagrammatic view of a third embodiment of the return guide device according to the invention.

In the third embodiment, shown in FIG. 10, the control lever 53 is connected via a control rod to a potentiometer 72, whose output is connected via a line 73 to an electric control unit 74. The output of the electric control unit 74 is applied via a line 75 to a control motor 76, by which the carrier 43 for the scanner lever 11 is adjustable via a control spindle 77.

In the exemplary embodiments of FIGS. 9 and 10 as well, the control device 2 for the displaceable bearing block 21 and the scanning device 1 can be disposed at arbitrary points of the traveling screen system, without any impairment in the operability of the return guide.

We claim:

1. A traveling screen system, comprising:

a plurality of support and guide rollers;

a traveling screen guided about said support and guide rollers;

a scanning device disposed to scan a transverse position of said traveling screen;

a carriage supporting a displaceable bearing block of one of said support and guide rollers;

an adjusting device disposed at a spacing distance from said scanning device and configured for adjusting an angular orientation of said one support and guide roller by adjusting a position of said bearing block; and feedback coupling means between said adjusting device and said scanning device for bridging said spacing distance and for feeding back a control motion of said one support and guide roller to said scanning device.

2. The traveling screen system according to claim 1 wherein said feedback coupling means comprise a Bowden cable.

3. The traveling screen system according to claim 1, wherein said feedback coupling means comprises a hydraulic circuit with a plurality of control cylinders.

4. The traveling screen system according to claim 1, wherein said feedback coupling means comprise an electric circuit with a plurality of control devices.

5. The traveling screen system according to claim 1, which comprises a carrier supporting said carriage, and a two-armed control lever supported on said carrier, said two-armed control lever including a first arm coupled to said carriage and a second arm coupled to said feedback coupling means.

6. The traveling screen system according to claim 5, wherein said first arm of said control lever has a slit formed therein, and said bearing block has a final control element engaging into said slit.

7. The traveling screen system according to claim 6, wherein said final control element of said bearing block is shiftable in a position relative to said control lever, for varying a controlling variable effected by a displacement of said bearing block.

8. The traveling screen system according to claim 5, wherein said feedback coupling means comprise a Bowden cable having a tension cable hinged to said second arm of said control lever.

9. The traveling screen system according to claim 5, said feedback coupling means comprise an hydraulic circuit including a first hydraulic cylinder with a piston rod hinged to said second arm of said control lever, a second hydraulic cylinder with a piston rod hinged to said scanning device, and a plurality of hydraulic lines connecting said first and second hydraulic cylinders.

10. The traveling screen system according to claim 5, wherein said feedback coupling means comprise an electric circuit and a control element for said electric circuit hinged to said second arm of said control lever, and an electric motor connected to said electric circuit for adjusting said scanning device.

* * * * *